US007207281B1

(12) United States Patent
Kasa

(10) Patent No.: US 7,207,281 B1
(45) Date of Patent: Apr. 24, 2007

(54) DRIVE ARRANGEMENT FOR COMPUTERIZED HAND-GUIDED QUILTING DEVICE

(76) Inventor: Zoltan Kasa, 4143 Bryson Cove Cir., Dublin, OH (US) 43016

( * ) Notice: Subject to any disclaimer, the term of this patent is extended or adjusted under 35 U.S.C. 154(b) by 0 days.

(21) Appl. No.: 11/381,150

(22) Filed: May 2, 2006

(51) Int. Cl.
*D05B 11/00* (2006.01)

(52) U.S. Cl. ..... 112/117; 112/470.13

(58) Field of Classification Search ..... 112/117, 112/118, 119, 470.12, 470.13
See application file for complete search history.

(56) References Cited

U.S. PATENT DOCUMENTS

| | | | | |
|---|---|---|---|---|
| 4,192,241 | A * | 3/1980 | Reed et al. | 112/117 |
| 6,631,688 | B1 * | 10/2003 | Maag | 112/118 |
| 6,792,884 | B1 * | 9/2004 | Barrus | 112/475.08 |
| 6,823,595 | B1 | 11/2004 | Bellavich | |
| 6,883,446 | B2 | 4/2005 | Koerner | |
| 6,932,008 | B2 | 8/2005 | Pfeifer | |
| 6,951,178 | B2 | 10/2005 | Watts | |
| 6,990,914 | B2 | 1/2006 | Canan | |
| 7,011,031 | B1 | 3/2006 | Bradley | |
| 2003/0200906 | A1 * | 10/2003 | Maag | 112/117 |

OTHER PUBLICATIONS

Townzen, Dee Dee, CompuQuilter, S & D Stitches, Inc., APQS Millenium Manual, Version 1.22, Revised Oct. 12, 2005, pp. 1-18.

Max Throat, Max Throat-How to turn your own home sewing machine into a long arm!, Mar. 29, 2006, webpage from http://maxthroat.com/maxworks.htm.

Max Throat, Max Throad-Sew 16 inch patterns with your own sewing machine!, Mar. 29, 2006, webpages from http://maxthroat.com/maxbasic.htm.

PC Quilter, PC-Quilter-More Information, More information on the PC Quilter, Apr. 11, 2006, webpages from http://www.pcquilter.com/moreinfo_main.htm.

* cited by examiner

*Primary Examiner*—Danny Worrell
(74) *Attorney, Agent, or Firm*—Standley Law Group LLP

(57) ABSTRACT

An improved computerized hand-guided quilting device has a quilting table (100) with a translation device (20). The translation device has a cross carriage (30) movable longitudinally atop the table or frame, and a sewing carriage (50) movable transversely atop the cross carriage. These translations allow X-Y movement of a sewing head (56) fixedly positioned on the sewing carriage. Automatic translation of the cross carriage is accomplished when an actuator (174) mounted on the cross carriage is placed into an operative contact that effects the translation, and manual translation is effected by disengaging the operative contact, using a selective engaging/disengaging means (176). Similarly, automatic translation of the sewing carriage is accomplished when an actuator (74) mounted on the sewing carriage is placed into an operative contact that effects the translation, but manual translation is effected by disengaging the operative contact, using a selective engaging/disengaging means (76).

10 Claims, 3 Drawing Sheets

DRIVE ARRANGEMENT FOR COMPUTERIZED HAND-GUIDED QUILTING DEVICE

TECHNICAL FIELD

The present invention relates to an improved arrangement of the drivers for a translation device of a computerized hand-guided quilting device. In an exemplary embodiment, the translation device is self-propelled in both the X and the Y directions relative to a quilting workpiece, using a pair of drive motors, each mounted upon a portion of the translation device which it drives.

BACKGROUND OF THE ART

In quilting, a top and bottom layer of fabric are sewn together, with a layer of a batting material interposed between the fabric layers. Quilting was once conducted completely by hand-stitching on the material, using a frame that places the material between a pair of take-up rolls.

Recently, the trend has been to mount a sewing head, either as a part of a conventional sewing machine or as a part of a "long arm" machine, on a hand-guided translation device, that is, a device translatable in the X and Y directions relative to the frame or table. A benefit of this system is the increased speed and efficiency of the sewing machine over manual stitching. The translation device usually comprises two carriages: a cross carriage movable on the table in a first direction (usually longitudinal on the table) and a sewing carriage movable on the cross carriage in a second direction, the second direction being orthogonal to the first direction (and usually referred to as "transverse"). On most of the long-arm machines, a sewing arm is equipped with a pair of axles to constitute the sewing carriage; in other situations, a sewing arm is fixedly mounted atop a carriage member to constitute the sewing carriage. A quilting frame or table providing this type of a translation device is referred to as a hand-guided quilting table or frame.

Even with the hand-guided quilting frame available, there is a continuing desire to increase the speed, efficiency and reproducibility of the increasingly-complex stitching patterns. By equipping the quilting frame with mechanical drive means for moving the sewing head relative to the material to be quilted, the reproducibility permitted by the computer can be realized. A quilting frame equipped in this manner is described as a computerized hand-guided frame. The sewing head of such a device may be hand-guided in a manual mode or computer-guided in a computerized or automatic mode. In the hand-guided mode, the sewing head is moved manually relative to the workpiece, which requires free motion of the translation device in at least one of the X and Y directions. In the computer-guided mode, the sewing head is moved relative to the workpiece in a pre-programmed pattern, based upon a control signal. This requires computer control of the translation device, usually through motors mounted remotely from the part being moved, the action of the motors being transmitted by the use of timing belts, steel wires and the like. In practical circumstances, an operator will frequently be switching from hand-guided operation to computerized operation and vice versa.

Some of the existing systems for computerizing have a "cable car" mode of operation, in which at least one of the motors for driving a moving part of the translation device is mounted on the table or fame. This drive motor is then mechanically linked to the cross carriage by a timing belt, steel wires, pulleys, etc. On the cross carriage itself, the drive motor used to drive the sewing carriage is located on the cross carriage and mechanically linked to the sewing carriage by timing belts, etc. The belt/wire design causes some difficulty in installation, as the length of belts and ropes must be carefully matched with the tables and carriages and belt/wire tensioners are needed to minimize movement errors.

In another known system, a self-propelled unit is positioned on the table adjacent to the translation device of the existing quilting device and a pair of orthogonal means on the self-propelled unit are mechanically connected to the corresponding carriages on the translation device. This requires careful coordination and matching of the "sidecar" unit to the translation device to make effective mechanical connection. In one case, the system uses a rack-and-pinion type of drive mechanism on the table (X-direction), with the rack portion thereof matching the physical dimensions of the table. Practically, a specific design of such a self-propelled unit, its translation means and the table rack is required for each different table/translation device combination. Further, the footprint of the table occupied by the sidecar unit effectively reduces the work area that may be reached by the sewing head.

All of these systems are characterized by one common feature—the driving motors are mounted remotely to the system being driven. Further, all of these systems have the disadvantage of the time and effort needed to switch between the hand-guided and computerized modes, which is required relatively frequently. The change entails removing bolts or pins that attach the carriage and the sewing arm to the timing belts or wires.

It is therefore an unmet need of the prior art to provide a means for automatically switching between automatic and manual modes, that is, engaging/disengaging the drive motors automatically.

SUMMARY OF THE INVENTION

This unmet need of the prior art is met by the present invention, as disclosed with regard to the exemplary embodiments shown and described. An improved hand-guided quilting device is provided. The hand-guided quilting device comprises a quilting table or frame with a translation device positioned atop the table or frame. The translation device comprises a cross carriage, translatable in a longitudinal direction atop the table or frame, and a sewing carriage having a sewing head, the sewing carriage translatable in a transverse direction atop the cross carriage. The quilting device also has a means for driving the cross carriage relative to the table or frame and a means for driving the sewing carriage relative to the cross carriage. The improvement lies in the cross carriage drive means, which comprise a first actuator, mounted on the cross carriage, and a means for selectively engaging and disengaging the first actuator into an operative contact that effects longitudinal translation of the cross carriage; and in the sewing carriage drive means, which comprises a second actuator, mounted on the sewing carriage, and a means for selectively engaging and disengaging the second actuator from an operative contact that effects transverse translation of the sewing carriage.

BRIEF DESCRIPTION OF THE DRAWINGS

The invention will be better understood when reference is made to the appended drawings, wherein identical parts are identified with identical reference numbers, and wherein.

DETAILED DESCRIPTION OF AN EXEMPLARY EMBODIMENT

Figure 1:
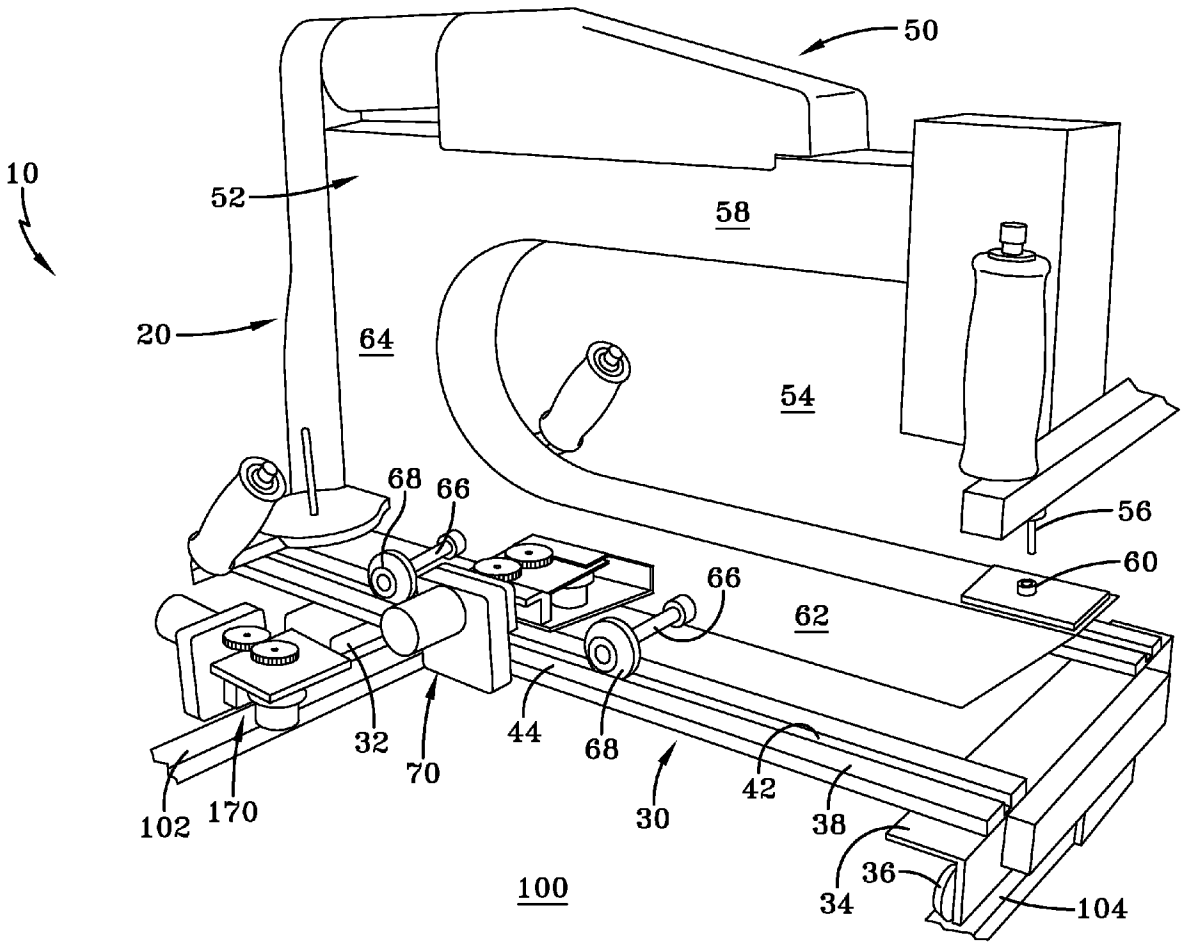
FIG. 1 shows a perspective view of an exemplary embodiment of the present invention.

FIG. 1 shows a perspective view of an exemplary embodiment 10 of a quilting device of the present invention. It is initially noted that many of the features of the quilting device 10 will be known to one of ordinary skill, but FIG. 1 further shows an embodiment of the improvements of the present invention installed on such a quilting device. The quilting device 10 is based upon a table 100. The table 100 is associated with a quilting frame (not shown), on which the material to be quilted is secured between a pair of rollers (not shown). The relationship of the table 100 and the frame is well-known and many references, including U.S. Pat. No. 7,011,031 B1, to Bradley, show this relationship.

A translation device 20 is shown as being mounted atop first and second rails or tracks 102, 104 that are fixed to the table 100. Of these, first rail 102 is mounted adjacent, and parallel, to a side edge of the table 100 and the second rail or track 104 is mounted inboard from the side edge. First and second rails 102, 104 are in parallel relationship. These rails or tracks 102, 104 are also in a parallel relationship to the pair of rollers on which the material to be quilted would be retained. The important feature of the rails or tracks 102, 104 is that they are associated with the quilting frame and especially with the rollers of the frame. The quilting frame is arranged to provide the material to be quilted in an X-Y plane, at a level above the plane represented by the surface of table 100. For reference purposes throughout this specification, the first and second rails 102, 104 will be described a extending longitudinally in the X-direction of the X-Y plane.

Translation device 20 is adapted to roll along tracks 102, 104 in the X-direction. To accomplish this, the translation device 20 has a cross carriage 30 and a sewing carriage 50. In the translation device 20 shown, the cross carriage 30 has a pair of linear end pieces 32, 34 that are adapted to roll along tracks 102, 104, respectively. To accomplish this, each of the end pieces 32, 34 has a plurality of freely rolling wheels 36, at least one of which is visible in FIG. 1. The cross carriage 30 is further formed by a pair of rails 38, 40. In the embodiment shown, each of the rails 38, 40 is attached near an inboard end thereof to end piece 34. The attachments are shown as being near the respective ends of end piece 34. However, the rails 38, 40 are attached to end piece 32 along an intermediate portion of the rails, so that an outboard end of the rails 38, 40 extends beyond end piece 32. The attachment of rails to end piece 32 is made near the respective ends of the end piece.

Rails 38, 40 have some visibly notable features. Each of the rails 38, 40 is orthogonal to rails 102, 104, the relationship being established by an orthogonal attachment to end pieces 32, 34. Rails 38, 40 are in parallel relationship to each other and extend in the Y-direction relative to the X-Y plane. Each of the rails 38, 40 is provided with a channel or rut 42 for receiving a wheel, as will be described below. Adjacent the channel or rut 42 on at least one of the rails 38, 40 is a strip 44 of planar surface. While rails 38, 40 are shown as being separate pieces, a single plate could be used in some embodiments, if a parallel pair of the channels or ruts 42 is provided and if each of these has the adjacent strip 44 of planar surface.

Translation carriage 20 also has a sewing carriage 50 that is adapted to roll along rails 38, 40 in the Y-direction. In the particular embodiments illustrated, the term "sewing carriage" is applied to a sewing machine 52 with an open throat area 54, a sewing head 56 attached to a upper arm 58 and a bobbin assembly 60 incorporated into a lower arm 62, with the sewing head and bobbin assembly aligned in a Z-direction, that is, orthogonal to the X-Y plane. The outboard ends of upper and lower arms 58, 62 are connected by upright member 64. The sewing machine 52 has been modified to provide the sewing carriage 50 by adding a pair of parallel axles 66 across lower arm 62, each of the axles having a freely-rolling wheel 68 at each end. These axles 66 and wheels 68 allow sewing carriage 50 to roll in the Y-direction, with wheels 68 engaging the channels or ruts 42.

An alternate design of a sewing carriage (not illustrated) would use a platform-like carriage that would ride in the Y-direction atop cross carriage 30, with a conventional sewing machine fixedly positioned atop the platform. The term "sewing carriage" in this patent specification is understood to encompass each of these embodiments, as well as any other embodiment in which a sewing head, such as sewing head 56, is positioned atop a cross carriage 30, with the sewing head able to move in the Y-direction relative to the cross-carriage.

With this understanding of the general structures that are known and used in computerized hand-guided quilting, attention is now directed to the further features of the exemplary embodiment, as these further features distinguish the embodiment from known devices.

The advantage of the quilting device 10 of the exemplary embodiment is that each carriage 30, 50 of the translation device 20 is self-propelled, through the use of onboard motors, rather than by being mechanically linked to a remote drive means associated with either the quilting table 100 or the cross carriage 30. This provides a substantial advantage over the known prior art.

Figure 2:
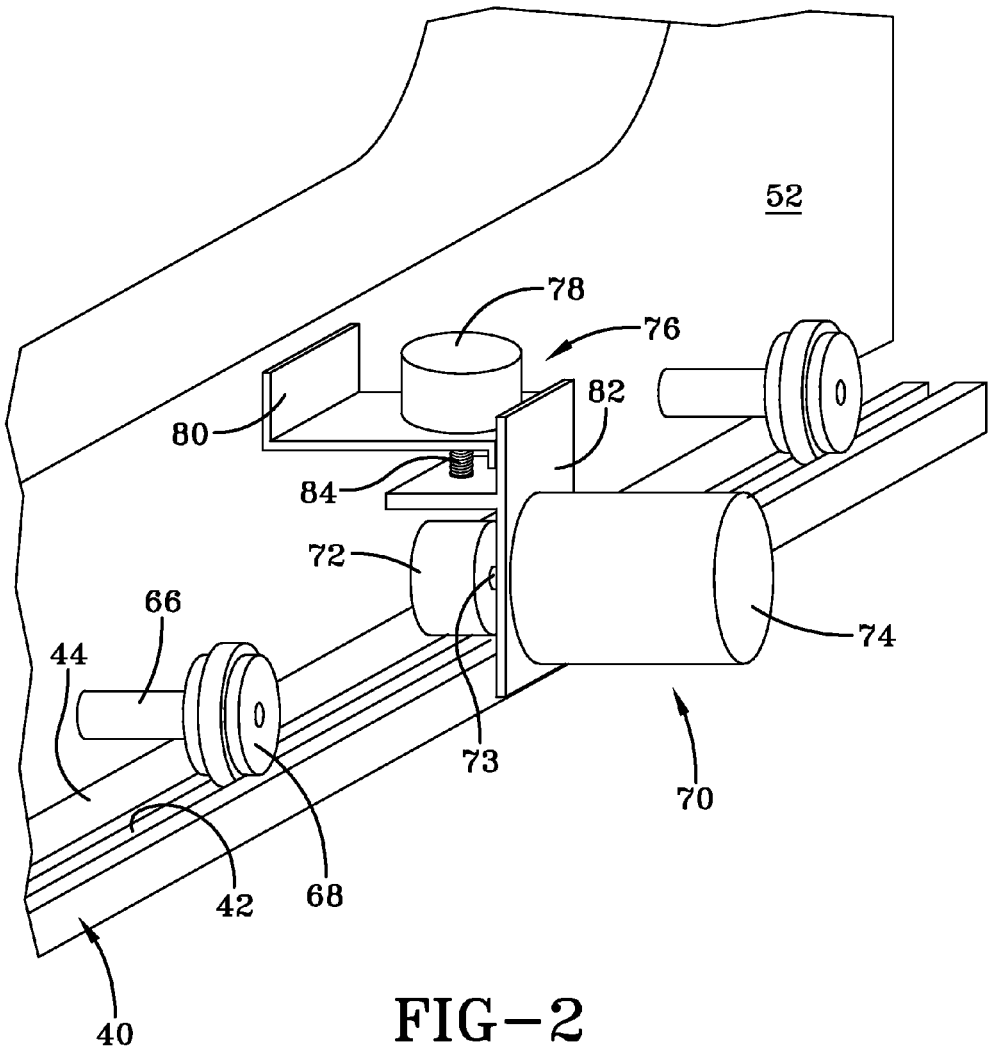
FIG. 2 shows an enlarged view of a first drive mechanism of the exemplary embodiment.

FIG. 2 is an enlarged perspective view of a drive means 70 for translating the sewing carriage 50 in the Y-direction in the channel 42 provided on cross carriage 30. Drive means 70 is fixedly mounted to lower arm 62. Note how freely-rolling wheels 68 have been adapted to closely engage the channel 42 in which they are positioned, effectively eliminating movement in the X-direction, while allowing Y-direction movement. Wheels 68 are preferably a rigid thermoplastic material with smooth surfaces, as they are not relied upon for traction. In the illustration, drive means 70 is mounted between the axles 66 of wheels 68, although this is clearly a design choice. Drive means 70 has a means for operatively contacting the cross carriage 30, the operative contact means being a friction roller 72 in the embodiment shown. The friction roller 72 is driven on a shaft 73 by a co-axially mounted motor 74, a particular embodiment of which may be a stepper motor. The illustrated rail 38, in which channel 42 is located, provides a stationary surface of the cross carriage 30. This combination of motor 74 and friction roller 72 provides the additional advantage of having the engaged motor act as a brake, effectively holding the sewing carriage 50 at a given position on cross carriage 30, preventing translation in the Y-direction.

An electrically-controlled lifting mechanism 76 provides automatic engagement/disengagement of the friction roller 72 from cross carriage 30. This allows quick switching between the hand-guided and computer-controlled operating modes, without having to make mechanical linkages or de-linkages. The particular lifting mechanism 76 illustrated uses a motor 78, illustrated as a direct current (DC) gear motor, mounted on a stationary bracket 80 that provides the rigid fixed attachment of the entire drive means 70 to the sewing carriage 50. A second mounting bracket 82 is provided to receive drive motor 74. Gear motor 78 drives a shaft, depicted in this embodiment as a screw 84, which is inserted in a threaded hole in the motor mounting bracket 82. Rotation of the screw 84 by operation of gear motor 78 moves mounting bracket 82 upwardly or downwardly in the Z-direction, depending upon the polarity of the voltage applied. When mounting bracket 82 lifts friction roller 72 from contact with the cross carriage surface provided by rail 38, free manual translation of the sewing assembly in the Y-direction is permitted. Since drive motor 74 always remains in mechanical linkage or communication with the sewing arm carriage 50 that it drives, and because friction roller 72 always remains physically proximate to the intended contact surface of cross carriage 30, engaging or disengaging the friction roller is a simple matter that obtains from actuating the lifting mechanism 76, which can be controlled by a computer (not illustrated).

Figure 3:
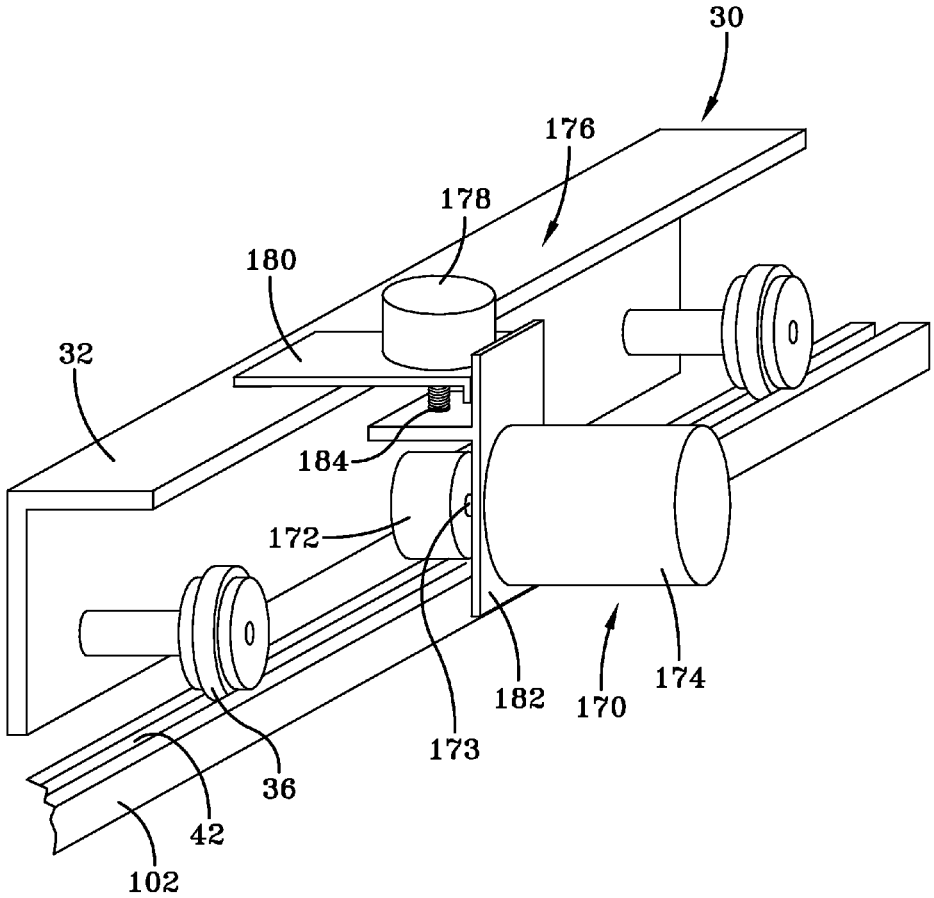
FIG. 3 shows an enlarged view of a second drive mechanism of the exemplary embodiment.

FIG. 3 provides similar details of a second drive means 170, which translates cross carriage 30 in the X-direction in the tracks 102, 104 provided on table 100. Drive means 170 is mounted in a fixed manner from end piece 32 of cross carriage 30, although the particular placement site on the cross carriage is a design choice. While none of the freely-rolling wheels 36 (see FIG. 1) are shown in FIG. 3, the conventional placement would have these wheels adapted to closely engage a channel provided in the track, effectively eliminating movement in the Y-direction, while allowing movement in the X-direction. In the illustrated embodiment, drive means 170 uses a friction roller 172 driven on a shaft 173 by a co-axially mounted motor 174, which is depicted as a stepper motor. The track 102, 104 or a planar surface adjacent to the track when a table is used, provides a suitable stationary surface for friction roller 172. Engaged motor 174 can act with friction roller 172 to lock cross carriage 30 relative to table 100, effectively preventing translation in the X-direction.

FIG. 3 also shows an electrically-controlled lifting mechanism 176 to automatically engage/disengage the friction roller 172 from the table 100, as a part of switching between hand-guided and computer-controlled operation. The particular lifting mechanism 176 illustrated uses a motor 178, depicted in this instance as a direct current (DC) gear motor, mounted on a stationary bracket 180 that provides the rigid fixed attachment of the drive means 170 to cross carriage 30, which it drives. Gear motor 178 drives a shaft, depicted in this embodiment as a screw 184, which is inserted in a threaded hole in the motor mounting bracket 182. Operation of gear motor 178 moves bracket 182 upwardly or downwardly in the Z-direction, depending upon the polarity of the voltage applied. When bracket 182 lifts friction roller 172 from contact with the table 100, free manual translation of the carriage in the X-direction is permitted. Since drive motor 174 always remains in mechanical linkage or communication with the cross carriage 30 that it drives, and because friction roller 172 always remains physically proximate to table 100, engaging or disengaging the friction roller is a simple matter that may be controlled by the same computer that provides the computer-controlled operation.

When motors 74, 174 are separately engaged, they act as "channel locks", i.e. selective brakes in one direction, allowing sewing horizontal or vertical lines, called channels, in hand-guided mode.

Unlike freely rolling wheels 36, 68, friction rollers 72, 172 are intended to provide traction and will typically be manufactured from a rubbery material that provides good traction. It will also be understood that friction rollers 72, 172 are only one embodiment of an operative contact means. For example, operative contact could also be indirectly established with the surface against which the drive force is applied, as through freely-rolling wheels 36, 68. In such a case, the operative contact means could be a clutch or transmission engagement that limits rotation of or drives the freely rolling wheel when engaged, but allows free rolling when disengaged.

While freely rolling wheels 36, 68 are shown engaged in "U" shaped channels, it will be appreciated that the use of a railroad-type raised track and railroad-type wheels would be similarly effective. In fact, other similar types of engagement, such as linear bearings, may be used instead of the freely rolling wheels in accomplishing the advantages of the present invention.

What is claimed is:

1. An improved computerized hand-guided quilting device, comprising a quilting table or frame with a translation device positioned atop the table or frame, the translation device comprising a cross carriage, translatable in a longitudinal direction atop the table or frame, and a sewing carriage having a sewing head, the sewing carriage translatable in a transverse direction atop the cross carriage, a driver for the cross carriage relative to the table or frame, and a driver for the sewing carriage relative to the cross carriage, wherein:

the cross carriage driver comprises:

a first actuator, mounted on the cross carriage, and a means for selectively engaging and disengaging the first actuator into an operative contact that effects longitudinal translation of the cross carriage; and the sewing carriage driver comprises:

a second actuator, mounted on the sewing carriage, and a means for selectively engaging and disengaging the second actuator from an operative contact that effects transverse translation of the sewing carriage.

2. The quilting device of claim 1, wherein each of the respective actuators comprises:

a motor with a shaft and a means for operatively contacting to effect translation, fixed to the shaft.

3. The quilting device of claim 2, wherein:

each of the selective engagement means is electrically controlled.

4. The quilting device of claim 1, wherein:

each of the selective engagement means is electrically controlled.

5. The quilting device of claim 3, wherein each selective engagement means comprises:

a first bracket, mounted to the carriage being driven;

a second bracket, on which the actuator is mounted; and a motor with a shaft, the motor mounted on the first bracket;

wherein selective rotation of the shaft moves the second bracket relative to the first bracket, engaging or disengaging the actuator from operative contact.

6. The quilting device of claim 1, wherein each selective engagement means comprises:

a first bracket, mounted to the carriage being driven;

a second bracket, on which the actuator is mounted; and a motor with a shaft, the motor mounted on the first bracket;

wherein selective rotation of the shaft moves the second bracket relative to the first bracket, engaging or disengaging the actuator from operative contact.

7. The quilting device of claim 2, wherein:

each means for operatively contacting is a friction roller.

8. The quilting device of claim 1, wherein:

each driver remains in mechanical communication with the carriage driven thereby.

9. An improved computerized hand-guided quilting device, comprising a quilting table or frame, a translation device positioned atop the table or frame, the translation device comprising a cross carriage and a sewing carriage with a sewing head fixedly positioned thereon, the cross carriage being translatable in a longitudinal direction atop the table or frame and the sewing carriage being translatable in a transverse direction atop the cross carriage, a driver for the cross carriage relative to the table or frame, and a driver for the sewing carriage relative to the cross carriage, wherein:

the cross carriage and sewing carriage drivers are each mounted on the respective carriages.

10. The quilting device of claim 9, further comprising:

means for selectively engaging and disengaging each driver, wherein each selective engagement means is integral to the driver.

* * * * *